US006314672B2

(12) United States Patent
Murello et al.

(10) Patent No.: US 6,314,672 B2
(45) **Date of Patent: *Nov. 13, 2001**

(54) HOUSING FOR A FIREARM

(75) Inventors: Johannes Murello, Rottweil; Rudolf Brandl, Dornhan; Wilhelm Fischbach, Deisslingen-Laufen, all of (DE)

(73) Assignee: Heckler & Koch GmbH, Oberndorf/Neckar (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/085,961

(22) Filed: May 27, 1998

(30) Foreign Application Priority Data

May 28, 1997 (DE) ..... 197 22 464

(51) Int. Cl.[7] ..... F41A 3/66; F41G 1/02; F41G 1/08

(52) U.S. Cl. ..... 42/75.02; 42/75.03; 42/16; 42/124; 42/135

(58) Field of Search ..... 42/71.01, 71.02, 42/75.01, 75.02, 75.03, 100, 16, 17, 18, 124, 135

(56) References Cited

U.S. PATENT DOCUMENTS

| | | | | |
|---|---|---|---|---|
| D. 141,078 | * | 5/1945 | Wheatley | 42/71.01 |
| 1,895,719 | | 1/1933 | Lahti | 89/197 |
| 2,389,631 | * | 11/1945 | Moore | 42/16 |
| 2,803,079 | * | 8/1957 | Heilman | 42/75.03 |
| 3,090,148 | | 5/1963 | Smith | 42/35 |
| 3,198,076 | * | 8/1965 | Stoner | 42/75.02 |
| 3,207,036 | * | 9/1965 | Norton | 89/191.01 |
| 3,225,653 | | 12/1965 | Packard | 89/1 |
| 3,323,246 | * | 6/1967 | Loffler | 42/75.02 |
| 3,939,589 | | 2/1976 | Tellie | 42/75.02 |
| 3,987,571 | | 10/1976 | Orozco | 42/71 R |
| 4,579,034 | * | 4/1986 | Holloway | 89/33.1 |
| 5,195,226 | | 3/1993 | Bornancini | 29/1.1 |

(List continued on next page.)

FOREIGN PATENT DOCUMENTS

| | | |
|---|---|---|
| 381118 | 10/1964 | (CH) . |
| 1 038 449 | 9/1958 | (DE) . |
| 0 260 239 | 3/1988 | (EP) . |

OTHER PUBLICATIONS

Louis Carabillo, Jr., *Project: Sky–Pup*, Guns Magazine, pp. 42–43 and 71–74, Aug. 1990.

European Patent Office, *European Search Report*, dated Dec. 9, 1998, in connection with European Patent Application Ser. No. EP 98 10 5327, which corresponds to the present U.S. application.

*Primary Examiner*—Stephen M. Johnson
(74) *Attorney, Agent, or Firm*—Marshall, Gerstein & Borun

(57) ABSTRACT

A housing for use with a firearm is provided. The housing includes a first housing section sized for receiving a barrel, and a second housing section coupled proximally to the first housing section for receiving a breechblock mechanism. The first housing section has a top external surface. The second housing section has a forward portion which is offset from the first housing section and which includes a forward surface defining an opening sized for receiving a connecting element operatively connecting a lever disposed adjacent the top external surface outside the first housing section and the breechblock within the second housing section. The connecting element moves perpendicularly to the opening and not, as in prior art housings, along it, so that the previously required longitudinal slit, which severely weakened the structure of prior art housings, is avoided.

14 Claims, 2 Drawing Sheets

U.S. PATENT DOCUMENTS

| | | | | |
|---|---|---|---|---|
| 5,343,650 | * | 9/1994 | Swan | 42/100 |
| 5,511,333 | | 4/1996 | Farrell | 42/49.01 |
| 5,513,461 | * | 5/1996 | Weldle | 42/75.02 |
| 5,636,465 | | 6/1997 | Johnson | 42/90 |
| 5,857,280 | | 1/1999 | Jewell | 42/69.03 |
| 6,070,354 | | 6/2000 | Buringana et al. | 42/71.01 |

* cited by examiner

HOUSING FOR A FIREARM

FIELD OF THE INVENTION

The invention relates generally to firearms and, more particularly, to an improved housing for a firearm.

BACKGROUND OF THE INVENTION

Prior art firearm housings include a longitudinal slit to receive a firing lever or a cocking slide which can be manually grasped and moved to load the weapon. Such longitudinal slits have appeared in many locations in prior art housings. For example, such longitudinal slits have been located just behind and/or bordering an ejection opening formed on the right side of the housing, on top of the housing in front of the breech, on the left long side of the housing, etc. The length of the longitudinal slit, if it does not grade into the ejection opening, is generally at least twice that of the cartridge. In many instances, the length of the slit is much longer than twice the length of the cartridge. This longitudinal slit is also often lengthened to the open rear end of the housing in order to permit assembly of the weapon. Such an approach is often used, for example, in instances where the firing lever is rigidly connected to the breech mechanism.

In addition to the ejection opening and the mentioned longitudinal slit, the housing also has other openings extending in the longitudinal direction of the housing. For example, prior art housings include an opening for receiving a magazine, and one or more opening(s) through which the trigger mechanism cooperates with the breech mechanism. The latter opening is also generally opened toward the rear end of the housing.

Box-like housings are advantageous in comparison with trough-like housings (for example, the housing used in the Russian Kalaschnikov M 74 automatic weapon). Trough-like housings are covered by a separate, non-supporting component. Box-like housings are advantageous over such trough-like housings in that the box-like housings remain sufficiently rigid even when their wall thickness is reduced. For this reason, for more than a half century (starting with the Sturmgewehr 44), sheet metal housings have mostly had the closed, box-like shape.

However, the rigidity of these box-like housings are severely compromised by the openings discussed above so that thin-walled sheet metal housings or plastic housings can only be used if the breech mechanism is directly locked with the barrel such that the housing is not used to transfer forces therebetween. Because of its great length, the aforementioned longitudinal slit makes a particularly significant contribution to reducing the rigidity of the housing.

In order to achieve good shooting results with each shot with limited design expenditure, a change has recently been made to adapt weapons so that they can be alternately used for right and left shooting with equal (particularly high) firing accuracy. In a weapon with a firing lever or cocking slide mounted on the side, the firing lever or cocking slide must be movable from one side of the housing to the other to facilitate manipulation thereof with the non-shooting hand of a user during loading. This arrangement, however, requires that two of the longitudinal slits mentioned above must be defined in the housing, one on each side for alternatively receiving the cocking slide. Since only one of these longitudinal slits will be in use at any given time, the unutilized slit can be optionally covered with a separate cover in order to avoid penetration of sand, dirt, and/or other debris into the housing. Moreover, especially in the so-called "bullpup" design in which the breech recoil extends to the rear end of the stock, two ejection openings are required since, during left sided shooting, the weapon must eject to the left and, during right sided shooting, the weapon must eject to the right.

From the foregoing it can be seen that the modifications to adapt a weapon to both left and right shooting result in a large number of openings in the housing. Among those openings, the longitudinal slits for the firing lever or cocking slide have a particularly adverse effect on the rigidity of the housing; especially when they are in communication with their corresponding ejection openings. Moreover, covering of the unused longitudinal slit is problematical. Each ejection opening can, however, be covered in the usual manner with a cover or cap, as is already used, for example, in the Sturmgewehr 44.

Prior art box-like housings generally do not include partitions or offsets in the region of the motion path of the firing lever or cocking slide. Offsets are avoided if possible, since they promote catching of the weapon by branches, and the like. Only the front wall of the magazine shaft could be viewed as a partition. In the region of the motion path, however, the outside of the housing is designed as smooth and continuous as possible.

SUMMARY OF THE INVENTION

In accordance with an aspect of the invention, a housing for use with a firearm is provided. The housing comprises a first housing section sized for receiving a barrel, and a second housing section coupled proximally to the first housing section for receiving a breechblock mechanism. The first housing section has a top external surface. The second housing section has a forward portion which is offset from the first housing section and which includes a forward surface defining an opening sized for receiving a connecting element operatively connecting a lever disposed adjacent the top external surface outside the first housing section and the breechblock mechanism within the second housing section.

In some embodiments, the forward surface of the forward portion of the second housing section is disposed at a front end of a motion path associated with the breechblock mechanism. In such embodiments, the forward surface of the forward portion of the second housing section may be substantially perpendicular to the motion path; the opening may be disposed in the center of the motion path; the forward surface of the forward portion of the second housing section may be arranged substantially laterally to the motion path; and/or the second housing section may define two ejection openings, the ejection openings being disposed on opposite sides of the motion path.

In some embodiments, the forward portion of the second housing section is substantially perpendicular to the top external surface of the first housing section; the opening is centered with respect to the top external surface; and/or the second housing section defines two ejection openings, the ejection openings being disposed on opposite sides of the second housing section.

In any of the foregoing embodiments, the first and second housing sections are preferably integrally formed.

Preferably, the first and second housing sections are at least partially constructed of plastic.

In any of the foregoing embodiments, the housing may further comprise a guide associated with the first housing section for guiding the lever longitudinally along the top external surface. In such embodiments, the guide may comprise at least one groove defined in the housing adjacent the top external surface.

In any of the foregoing embodiments, the opening is preferably oriented to receive a connecting element oriented substantially perpendicular to the front surface.

Preferably, the housing is incorporated into a firearm, and/or the housing comprises a box-like housing.

Other features and advantages are inherent in the apparatus claimed and disclosed or will become apparent to those skilled in the art from the following detailed description and its accompanying drawings.

DESCRIPTION OF THE PREFERRED EMBODIMENT

As used throughout this specification and claims, the term "firearm" is defined to include automatic, semi-automatic, manual and self-loading weapons, handguns, self-loading grenade launchers, combined weapons (two combined self-loading systems to shoot different cartridges), and the like. Moreover, for ease of explanation certain positional terms are used throughout this application. As used herein, positional terms such as "front" or "top" refer to the position of the weapon when the housing is disposed in the normal, horizontal firing position, in which the muzzle is "in front" of, and pointed away from, the user.

Figure 1:
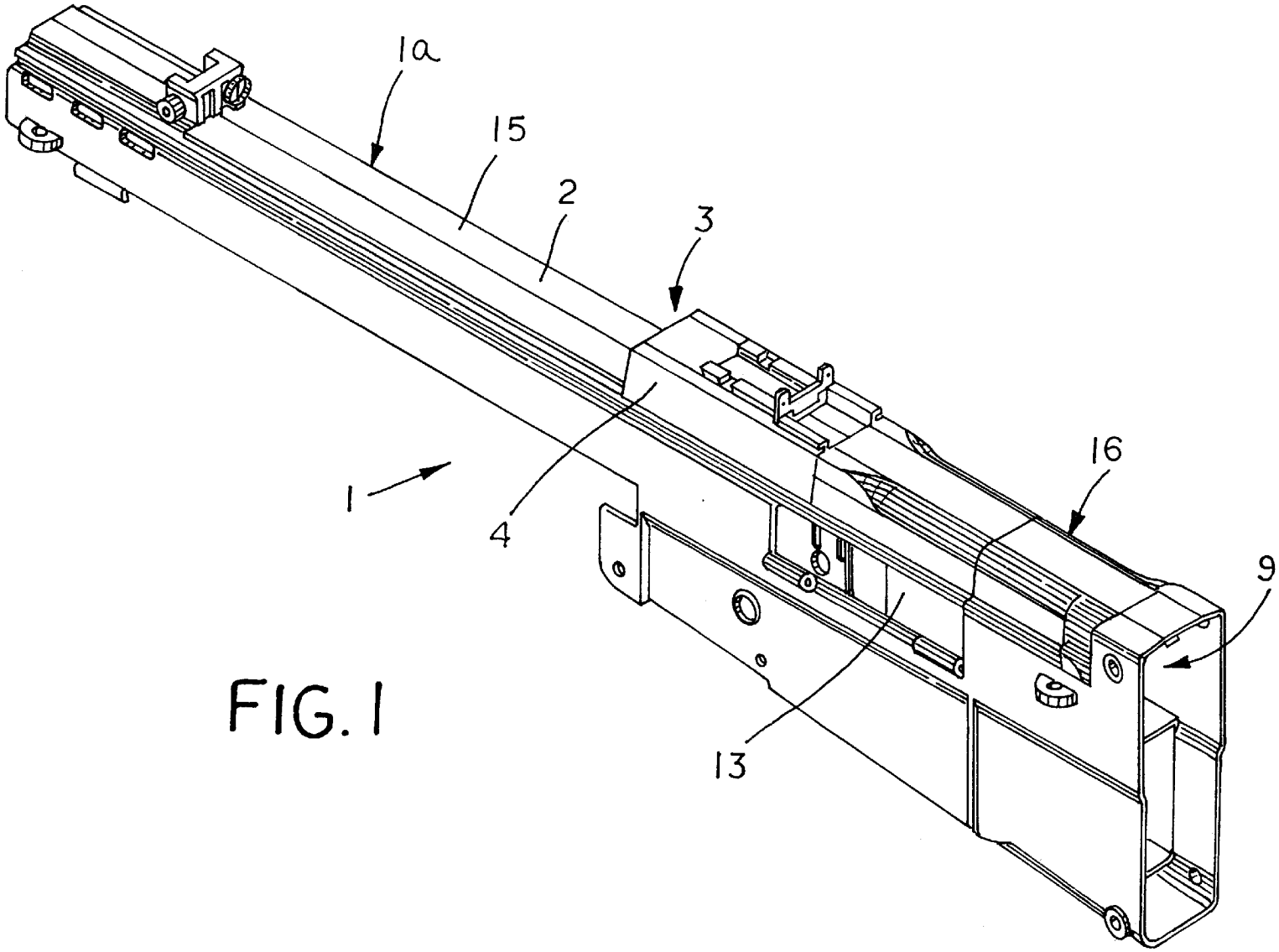
FIG. 1 is a top, rear perspective view of a firearm housing constructed in accordance with the teachings of the invention.

A box-like housing 1 for use in a firearm and constructed in accordance with the teachings of the invention is shown in FIG. 1. The housing 1 is preferably produced from plastic by injection molding. On particularly stressed sections of the housing 1, steel sheet parts can be incorporated in the plastic. For example, steel sheeting may optionally be employed along the motion path on the top surface 2 discussed below.

As shown in FIG. 1, the housing 1 includes a first housing section 1*a* sized for receiving a barrel, and a second housing section 1*b* coupled proximally to the first housing section 1*a* for receiving a breechblock mechanism. The front housing section 1*a* of the housing 1 comprises a square tube which serves to accept a barrel and optionally the corresponding gas piston. The front housing section 1*a* has a top external surface 2 disposed above the square tube. The front housing section 1*b* is preferably integrally formed with, and in communication with, the box-like rear housing section 1*b*.

The rear housing section 1*b* has a forward portion 4 which is upwardly offset from the front housing section 1*a*. In other words, the rear housing section 1*b* protrudes upwardly above the front housing section la forming an offset 3. The rear housing section 1*b* is lengthened downward by a magazine shaft. Behind this magazine shaft, the rear housing section 1*b* has a mounting space for a trigger mechanism. Moreover, the rear section 1*b* has a lower, inside wall that ensures that the rear part 1*b* of the housing 1 forms a closed, box-like, hollow profile. This closed hollow profile is only interrupted by the lower opening for cartridge feed, and by two ejection openings 13, one on each side of the section 1*b*. The box-like housing 1 is open to the front and rear.

Figure 2:
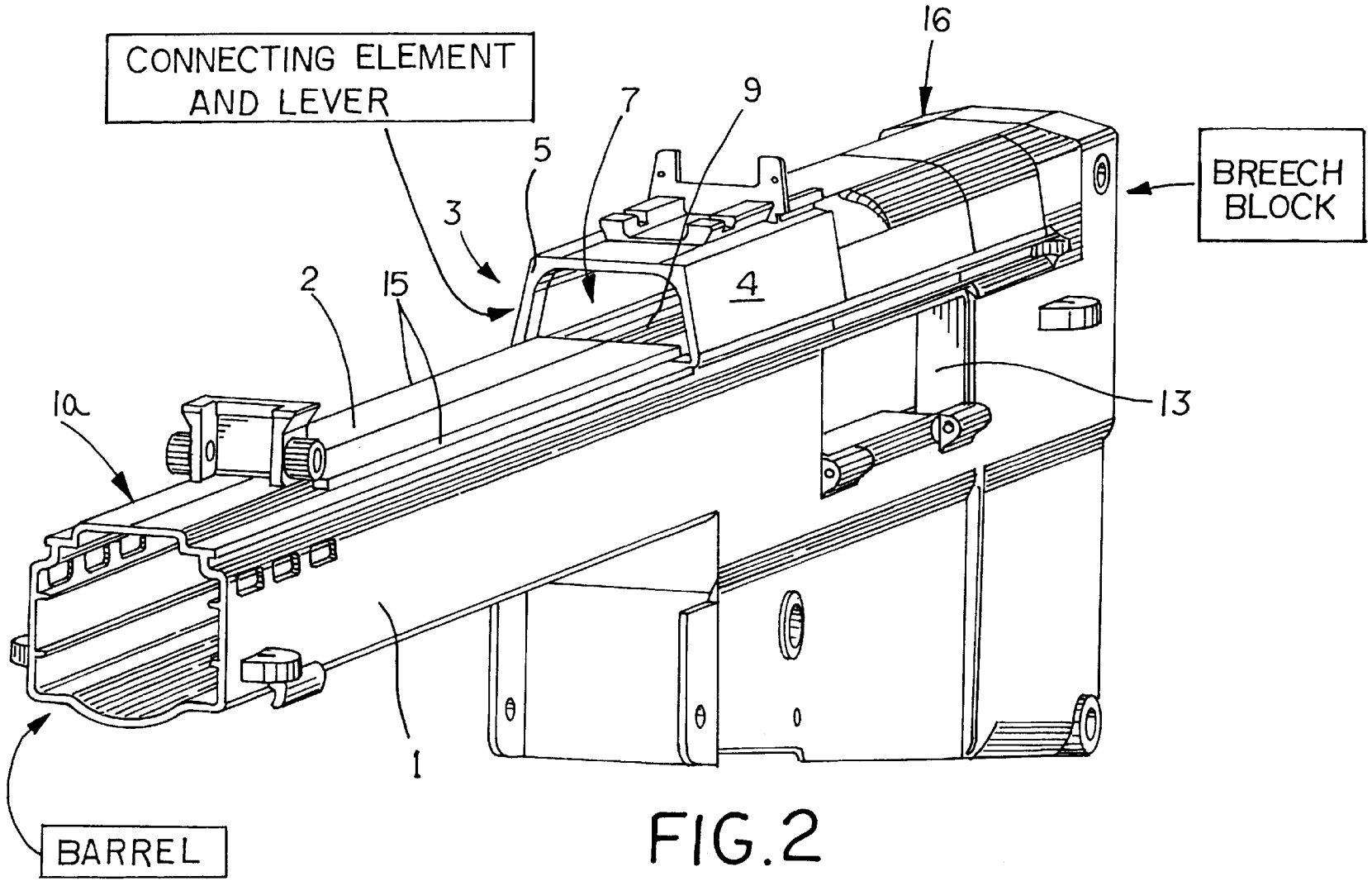
FIG. 2 is a top, front perspective view of the housing of FIG. 1 drawn on a slightly larger scale than the depiction in FIG. 1.

A guide track 9 is defined in the rear housing section 1*b* (see FIG. 2). A breech mechanism comprising, for example, a breechblock (not shown) is situated in the interior of the rear housing section 1*b* at the level of the front part and in its continuation. In particular, the breechblock mechanism cooperates with the guide track 9 and is guided thereby in forward and backward movements within the housing section 1*b*. The reciprocating movements of the breechblock mechanism along the guide track 9 within the housing 1*b* define a motion path.

The offset 3 is formed by a front surface or partition 5 of the forward portion of the rear housing section 1*b*, which is preferably arranged perpendicularly to the direction of guide track 9 and, thus, perpendicularly to the motion path. The front surface 5 of the rear housing section 1*b* defines, and is penetrated by, an opening 7. This opening 7 is sized to receive a connecting element operatively connecting (a) a lever (such as a firing lever or cocking slide) disposed adjacent the top external surface 2 outside the front housing section 1*a*, and (b) the breechblock mechanism within the rear housing section 1*b*. Although in the illustrated embodiment, the opening 7 is designed in the form of a regular trapezoid in which the larger base lies on the bottom, persons of ordinary skill in the art will readily appreciate that other shapes could likewise be employed without departing from the scope of the invention. In the illustrated embodiment, the opening 7 is almost as large as the front surface or partition 5 so that only a frame or connector remains. This frame extends around opening 7, except on the bottom. Persons of ordinary skill in the art will, however, appreciate that other sizes can be utilized for opening 7 without departing from the scope of the invention.

Two grooves are formed in the front housing section 1*a* of housing 1 adjacent the top surface 2. One groove 15 is disposed on each side of the surface 2. The grooves 15 run parallel to each other and form a guide 15 that extends parallel to the motion path 9. This guide 15 starts at the bottom of opening 7 and extends longitudinally forward along the front housing section 1*a*. The guide 15 is set up to guide a firing lever or cocking slide arrangement (not shown) to move longitudinally along the top external surface 2 of the front housing section 1*a*. The lever arrangement is connected to a breech mechanism (not shown) via the connecting element (not shown) which extends with limited play to the peripheral ledge of opening 7 and is moveable therethrough.

Advantageously, the guide 15 prevents a force exerted on the firing lever or the like from having an adverse effect on the breechblock mechanism under the influence of the connecting element as a lever. The guide 15 can have the shape of a dovetail connector, a dovetail groove, two opposite grooves facing away from each other or facing toward each other or the like. Embodiments employing the guide 15 are particularly advantageous in a plastic housing, since no additional costs are incurred by this longitudinal guide and, since during shooting, the connecting element or firing lever guided in the guide 15 has an additional stiffening effect on the housing 1.

Advantageously, the distortion and bending rigidity of the housing 1 is insubstantially affected by the presence of the opening 7. The connecting element preferably has the shape of a general prism or cylinder (with a parallel shifted line as generatrix). Unlike known weapons, in the illustrated embodiment, no longitudinal slit through which dust, sand or the like can reach the interior of the weapon is opened during loading or reloading. Moreover, the opening 7 need only exhibit a slightly larger cross section than the connecting element, which moves in the direction of the breech movement, (i.e., perpendicular to the plane of the opening and also forward and backward). In other words, the opening 7 need not extend over the entire transverse or lateral length of the motion path, but only over a significantly smaller zone, which essentially corresponds to the diameter of the connecting element. Any annular gap between the opening 7 and the periphery of the connecting element can be made so narrow that no sand or the like can penetrate into the interior of the housing 1. However, it is also advantageous to optionally locate a sealing ring in the opening 7, perhaps made from a lip profile of a low-friction material, which is always in sealing engagement with the connecting element without hampering its movement.

Advantageously, because the moving firing lever arrangement is situated in the region of the weapon that lies directly beneath the sighting line, it does not come into contact with branches or the like during shooting. (If such contact were to occur one would be unable to see during aiming, and would, thus, move the weapon or branch to another location.) This region of the weapon should not be grasped when handling the weapon so that movement of the firing lever arrangement can occur unhampered.

As shown in FIG. 2, a hinge part is located beneath each of the ejection openings 13 (only the left one is shown). A cover can be secured by a pin or axis in the hinge part. The cover is designed to close the corresponding ejection opening 13. The breech mechanism preferably can be fitted for ejecting spent cartridges either to the right or to the left. To this end, it preferably has a trigger which is adjustable to the corresponding direction, and which, opens the appropriate cover and keeps the other one closed.

The firing lever or cocking slide device can also, upon adjustment, be fitted so that the corresponding firing lever in a weapon ejecting to the right can be folded leftward and in a weapon ejecting to the left can be folded rightward. A firing lever or cocking slide is mounted in the usual manner rigidly or foldably on the end of the connecting element.

Since over most sites of its length, the housing 1 has a hollow cross section with a closed periphery, it is extremely resistant to distortion overall. Even with large dimensions (for example, in a very large caliber weapon) the housing 1 can be made from plastic, aluminum or thin steel sheet so that it is quite light, despite its size, with still adequate rigidity.

The flanges and crimps running in the longitudinal direction along the housing 1 ensure the housing 1 has the capability of accepting extremely high loads in the longitudinal direction. Despite its limited weight the housing 1 can, therefore, also withstand the recoil forces of very large cartridges for long periods.

Although persons of ordinary skill in the art will appreciate that the front surface or partition 5 of the rear housing section 1*b* could be arranged, for example, laterally next to the motion path near its rear end and on the end of a tunnel-like, longitudinally running housing section that encloses the motion path of the connecting element in the interior of the housing, in the preferred embodiment the partition 5 is arranged laterally at the front end of the motion path. As mentioned above, the connecting element is designed merely as a straight rod extending in the longitudinal direction of the housing 1. The rod, which is attached by its rear end to the breechblock mechanism, extends through the opening 7 on the end of the motion path and carries the firing lever or the like on its front end. In a weapon with a magazine mounted underneath and utilizing lateral cartridge ejection, the opening 7 preferably lies above the barrel of the weapon. In a differently designed weapon, perhaps a weapon with belt feed, however, another arrangement of the front surface 5 and opening 7 could be chosen so that the reloading and ejection process is not disturbed by the connecting element.

The preferred arrangement wherein the front surface 5 and the opening 7 are located above the barrel is advantageous in that the region above the barrel usually remains free in all use situations of the weapon. It is, therefore, possible to utilize an arrangement in which the connecting element is always rigidly connected to both the breechblock mechanism and the firing lever or the like, so that, during the loading movement of the breechblock mechanism, the connecting element and firing lever move together with the breechblock mechanism. The firing lever can be folded down so that it has no protruding parts during normal operation. However, persons of ordinary skill in the art will appreciate that the firing lever can optionally be made disconnectable from the breechblock mechanism so that it remains fixed in its position when the breechblock mechanism moves during shooting without departing from the scope of the invention.

Persons of ordinary skill in the art will further appreciate that in the case of loading disturbances, (for example, if the breechblock mechanism does not fully lock as a result of soiling), the breechblock mechanism can be simply locked tight by means of the firing lever.

It will further be appreciated that the partition or front surface 5 need not be flat. Further, it will be appreciated that the front surface 5 need not be exactly perpendicular to the motion path of the breechblock mechanism. In the preferred embodiment, however, the area of the partition relative to the motion path that includes the opening 7, is perpendicular to the motion path in order to keep the opening 7 as small as possible and to permit the most effective possible sealing of the housing-internal space at the gap between the edge of the opening 7 and the periphery of the connecting element. In this context it is also preferred that the connecting element have a peripheral surface that can be described as a generatrix by parallel movement of a line, at least along the region that moves back and forth in the opening 7.

The opening 7 is preferably centered in the front surface 5. Thus, the opening 7 is preferably centered with respect to the motion path discussed above. As a result, the connecting element is preferably centered with respect to the housing 1 and can remain in its centered position regardless of whether the weapon is converted to left or right shooting.

Instead of a center opening 7, two off-center openings could optionally be provided. In such an embodiment, either an off-center connecting element which is passed through the corresponding opening during refitting for right or left shooting is provided, or two connecting elements can be employed wherein each connecting element is located in a respective one of the openings at all times. In either case, the presence of the two small openings has even a smaller effect on the distortion rigidity of the housing 1 than does the presence of a single larger opening 7.

If two partitions are present, (one on each side of the motion path), for refitting the weapon to right or left shooting, the unused opening can be simply closed with a plug. Thus, instead of two long longitudinal slits, only two comparatively small openings are provided. Moreover, the region adjacent these openings is braced by the partition 5 so that the openings insignificantly effect the rigidity of the housing 1.

Persons of ordinary skill in the art will appreciate that the rigidity of the disclosed housing 1 is so insignificantly effected by the one opening (or optionally two openings) that it can have two oppositely located ejection openings 13, one of which is set up for right shooting and one for left shooting and still be rigid enough for most applications. As discussed above, the unused ejection opening remains closed, perhaps by a plug, but preferably by a pivotable cover. The cover that closes the used ejection opening can be unlocked from the inside by the breechblock mechanism, if necessary, and opened by a spring.

Even if the box-like housing 1 includes the two ejection openings 13, the housing 1 is so rigid due to its construction that it can be made from plastic or reinforced plastic instead of steel sheet. The lower weight relative to a steel sheet housing is naturally advantageous. In addition, great dimensional stability without machining is attainable by injection molding.

From the foregoing, persons of ordinary skill in the art will appreciate that a box-like housing 1 has been provided. The box-like housing 1 decidedly increases the rigidity of the firearm(s) in which it is incorporated. Persons of ordinary skill in the art will further appreciate that firearms which incorporate the disclosed housing 1, are lightweight but durable.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. In combination, a firearm comprising:

a breechblock mechanism;

a lever;

a connecting element;

a first housing section sized for receiving a barrel, the first housing section having a top external surface; and a second housing section coupled proximally to the first housing section for receiving the breechblock mechanism, the second housing section having a forward portion which protrudes relative to the first housing section and which includes a forward surface defining an opening sized for receiving the connecting element operatively connecting the lever disposed adjacent the top external surface outside the first housing section and the breechblock mechanism within the second housing section.

2. A housing as defined in claim 1 wherein the forward surface of the forward portion of the second housing section is disposed at a front end of a motion path associated with the breechblock mechanism.

3. A housing as defined in claim 2 wherein the forward surface of the forward portion of the second housing section is substantially perpendicular to the motion path.

4. A housing as defined in claim 2 wherein the opening is disposed in the center of the motion path.

5. A housing as defined in claim 2 wherein the forward surface of the forward portion of the second housing section is arranged substantially laterally to the motion path.

6. A housing as defined in claim 2 wherein the second housing section defines two ejection openings, the ejection openings being disposed on opposite sides of the motion path.

7. A housing as defined in claim 1 wherein the forward surface of the forward portion of the second housing section is substantially perpendicular to the top external surface of the first housing section.

8. A housing as defined in claim 1 wherein the opening is centered with respect to the top external surface.

9. A housing as defined in claim 1 wherein the second housing section defines two ejection openings, the ejection openings being disposed on opposite sides of the second housing section.

10. A housing as defined in claim 1 wherein the first and second housing sections are integrally formed.

11. A housing as defined in claim 1 wherein the first and second housing sections are at least partially constructed of plastic.

12. A housing as defined in claim 1 further comprising a guide associated with the first housing section for guiding the lever longitudinally along the top external surface.

13. A housing as defined in claim 12 wherein the guide comprises at least one groove defined in the housing adjacent the top external surface.

14. A housing as defined in claim 1 wherein the connecting element is oriented substantially perpendicular to the forward surface, and the opening is oriented to receive the connecting element.

* * * * *